US006427875B1

(12) United States Patent
Hoang et al.

(10) Patent No.: US 6,427,875 B1
(45) Date of Patent: Aug. 6, 2002

(54) FOAM DISPENSING DEVICE

(75) Inventors: Minh Quang Hoang, Taylorsville; Jonathan Karl Burkholz, Salt Lake City; Donald Edward Hunt, Provo, all of UT (US)

(73) Assignee: Becton, Dickinson and Company, Franklin Lakes, NJ (US)

( * ) Notice: Subject to any disclaimer, the term of this patent is extended or adjusted under 35 U.S.C. 154(b) by 0 days.

(21) Appl. No.: 09/537,195

(22) Filed: Mar. 28, 2000

(51) Int. Cl.[7] ..... B67D 5/58

(52) U.S. Cl. ..... 222/190; 222/180; 222/321.7; 222/321.9; 222/464.1

(58) Field of Search ..... 222/180, 143, 222/190, 321.7, 321.9, 464.1, 464.7, 464.3, 464.4, 327, 382

(56) References Cited

U.S. PATENT DOCUMENTS

| | | | | | |
|---|---|---|---|---|---|
| 2,545,988 | A | * | 3/1951 | Bobrick | 222/321.9 |
| 3,490,656 | A | * | 1/1970 | Taschner | 222/394 |
| 3,937,364 | A | | 2/1976 | Wright | 222/190 |
| 3,966,095 | A | * | 6/1976 | Chappell | 222/384 |
| 4,018,364 | A | * | 4/1977 | Wright | 222/190 |
| 4,138,036 | A | * | 2/1979 | Bond | 222/105 |
| 4,582,227 | A | * | 4/1986 | Kanfer | 222/153 |
| 4,932,567 | A | * | 6/1990 | Tanabe et al. | 222/321.7 |
| 5,016,783 | A | * | 5/1991 | Hayes et al. | 222/321 |
| 5,037,006 | A | | 8/1991 | Kock | 222/190 |
| 5,271,530 | A | | 12/1993 | Uehira et al. | 222/190 |
| 5,443,569 | A | * | 8/1995 | Uehira et al. | 222/190 |
| 5,522,548 | A | * | 6/1996 | Gallien et al. | 239/337 |
| 5,570,819 | A | * | 11/1996 | Uehira et al. | 222/190 |
| 5,954,239 | A | * | 9/1999 | Evans et al. | 222/464.4 |
| 6,202,943 | B1 | * | 3/2001 | Evans et al. | 239/333 |

FOREIGN PATENT DOCUMENTS

JP 63-317484 * 12/1988

OTHER PUBLICATIONS

English translation of Japanese Patent 63–317484 to Hanada.

* cited by examiner

*Primary Examiner*—William C. Doerrler
*Assistant Examiner*—Frederick C Nicolas
(74) *Attorney, Agent, or Firm*—James J. Murtha

(57) ABSTRACT

A foam dispensing device is disclosed. The device includes a container for holding a foamable liquid and having at least one planar surface and a foam generating piston pump removably attached to the container to prevent liquid leaking from the container. The device can dispense foam when substantially the entire quantity of the liquid has been dispensed from the container when the container is in positioned in a first, generally horizontal position, or a second, generally vertical position.

7 Claims, 4 Drawing Sheets

FOAM DISPENSING DEVICE

FIELD OF THE INVENTION

The present invention relates to foam dispensing devices. More particularly, the present invention relates to portable foam dispensing devices for dispensing a foamable solution, for example, an antimicrobial solution.

BACKGROUND OF THE INVENTION

Bulk antimicrobial solution dispensing systems are used by clinicians in the healthcare industry for hand washing and infection control activities. Examples of these bulk antimicrobial solution dispensing systems include Becton Dickinson's E-Z SCRUB® Antimicrobial Foam Solution products, and Baxter's Scrub Care™ liquid solution dispensing system.

Two major areas of the healthcare hand washing market are in the operating room, where surgical scrubbing takes place, and outside of the operating room. In the operating room area, foot pump activated dispensers are utilized because scrubbing procedures do not allow hand activated dispensers, while elsewhere throughout the hospital, hand pump activated dispensers are used. Hand pump activated dispensers also target the growing home healthcare and food handler markets covering a broader range of hand washing markets.

Other hand pump activated foam dispensers currently available in the healthcare and other industries rely on the combined use of a bottle or container holding a foamable solution and a wall mounted bracket. The solution containing bottle assembly contains a foaming device capable of generating a foamed solution only when used in conjunction with the appropriate hand pump wall mounted bracket, thereby limiting the foam dispensers use to locations where such a bracket is installed. In these instances, the wall mounted brackets contain the air delivery mechanisms including a piston, check valve and housing, which often require maintenance over the life of the product. Such maintenance can be time consuming and expensive.

It would be desirable to provide a foam dispensing device that included a disposable, uniquely designed container for use as a "stand alone", hand pump activated, antimicrobial foam dispenser. It would be useful if such a dispensing device was both portable and also capable of being easily mounted to a generally vertical surface.

SUMMARY OF INVENTION

Accordingly, the present invention generally provides a foam dispensing device comprising a container for holding a foamable liquid and having at least one planar surface, a foam generating piston pump attached to the container to prevent liquid leaking from the container and a dip tube having a first end connected to the piston pump for supplying liquid to the piston pump to generate foam. The dip tube has a second end positioned adjacent the planar surface so that the foam dispensing device can dispense foam when substantially the entire quantity of the liquid has been dispensed from the container when the container is positioned in a first, generally horizontal position, or a second, generally vertical position. Preferably, the piston pump is attached to the container by a threaded connection. The piston pump preferably includes a nozzle capable of being rotated independently of the threaded connection to provide for the directional adjustment of the nozzle. In one embodiment, the foam dispensing device includes means for removably mounting the container to a generally vertical surface.

The present invention provides a portable foam dispensing device that can be used when the device is placed in a generally horizontal position, such as on a table top. The device can also be used when mounted to a generally vertical surface because the dip tube is positioned so that the dip tube draws liquid from the container when the foamable liquid in the container has been substantially emptied.

Additional features and advantages of the invention will be set forth in the description which follows. It is to be understood that both the foregoing general description and the following detailed description are exemplary and explanatory and are intended to provide further explanation of the invention as claimed.

DETAILED DESCRIPTION

Figure 1:
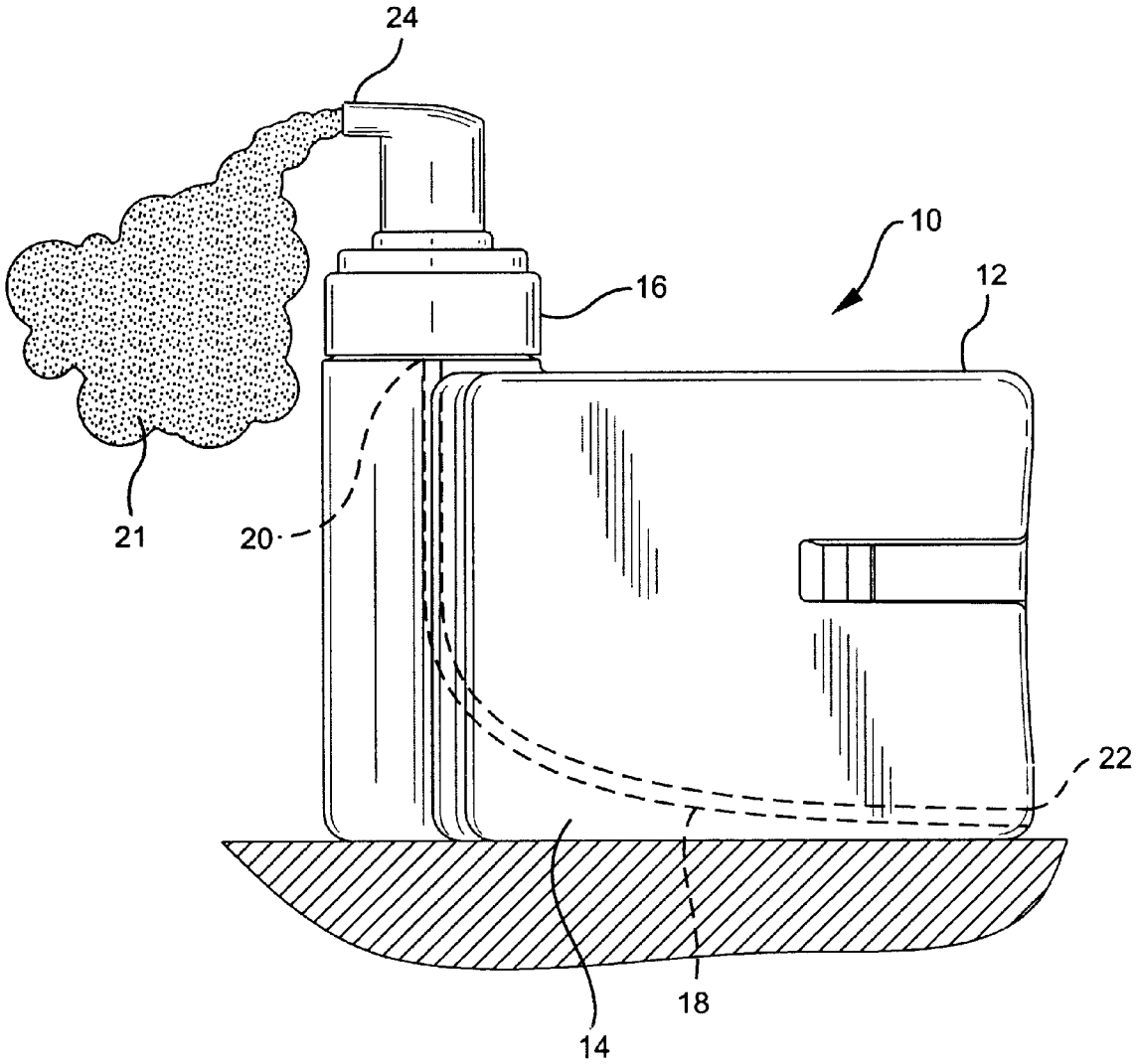
FIG. 1 is a side view of a foam dispensing device in a generally horizontal position according to one embodiment of the invention.

Reference will now be made in detail to the present preferred embodiment of the invention, an example of which is illustrated in the accompanying drawings. An exemplary embodiment of the foam dispensing device of the present invention is shown in FIG. 1 and is designated generally by reference numeral 10.

As embodied herein and referring to FIG. 1, foam dispensing device 10 includes a container 12 for holding a foamable liquid and having at least one planar surface 14. The foam dispensing device 10, includes a foam generating piston pump 16 attached to the container to prevent liquid leaking from the container. The piston pump 16 is attached to the container to form a fluid-tight seal so that when the container is utilized in a vertical position, as described further below, fluid does not leak from the container. Preferably, the piston pump 16 is attached to the container by a threaded, fluid tight connection between the container 12 and the piston pump 16. A suitable piston pump is available from Airspray International, Pompano Beach, Fla.

Figure 2A:
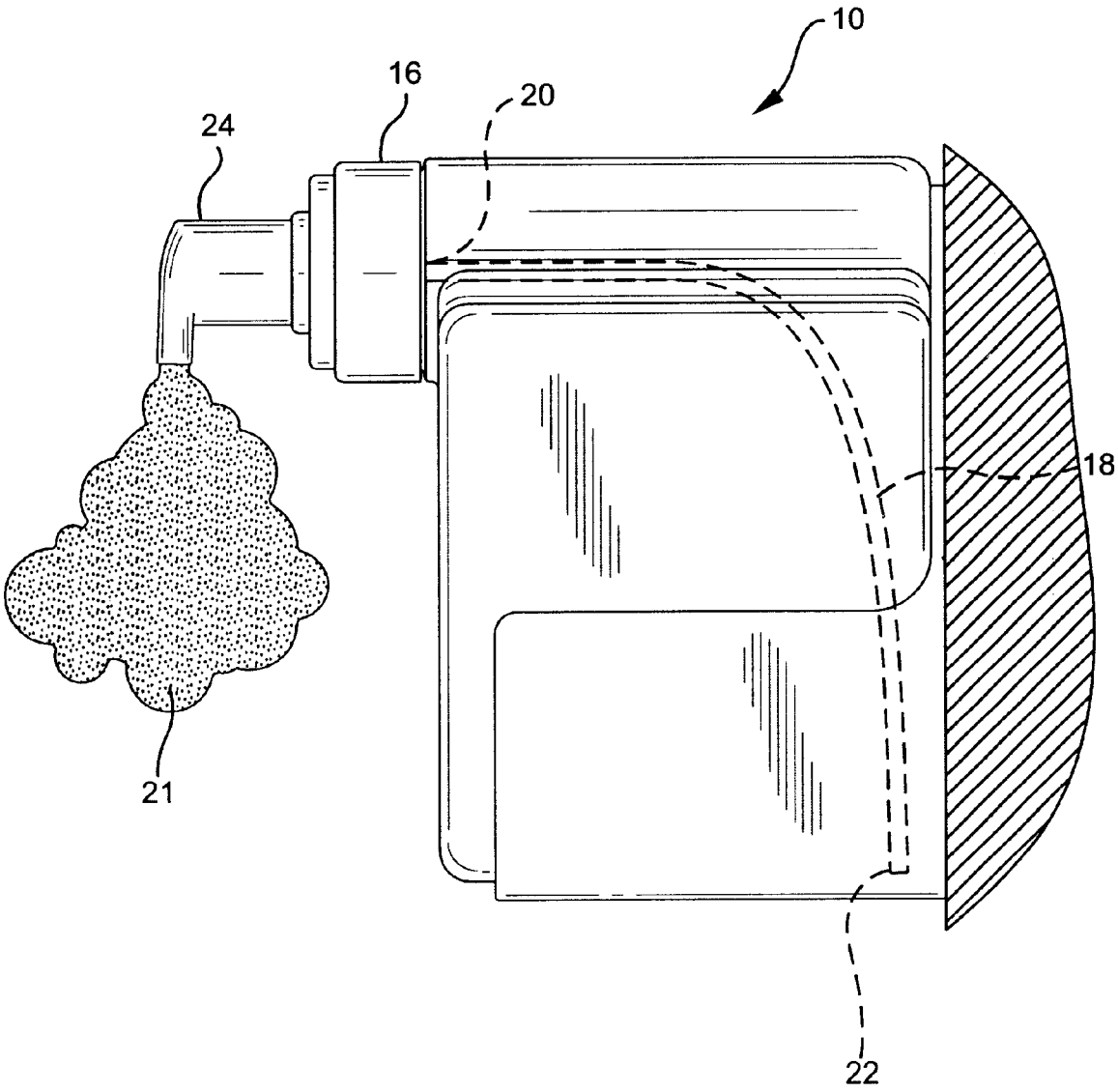
FIGS. 2*a* and 2*b* shows a foam dispensing device in a generally vertical position.
Figure 2B:
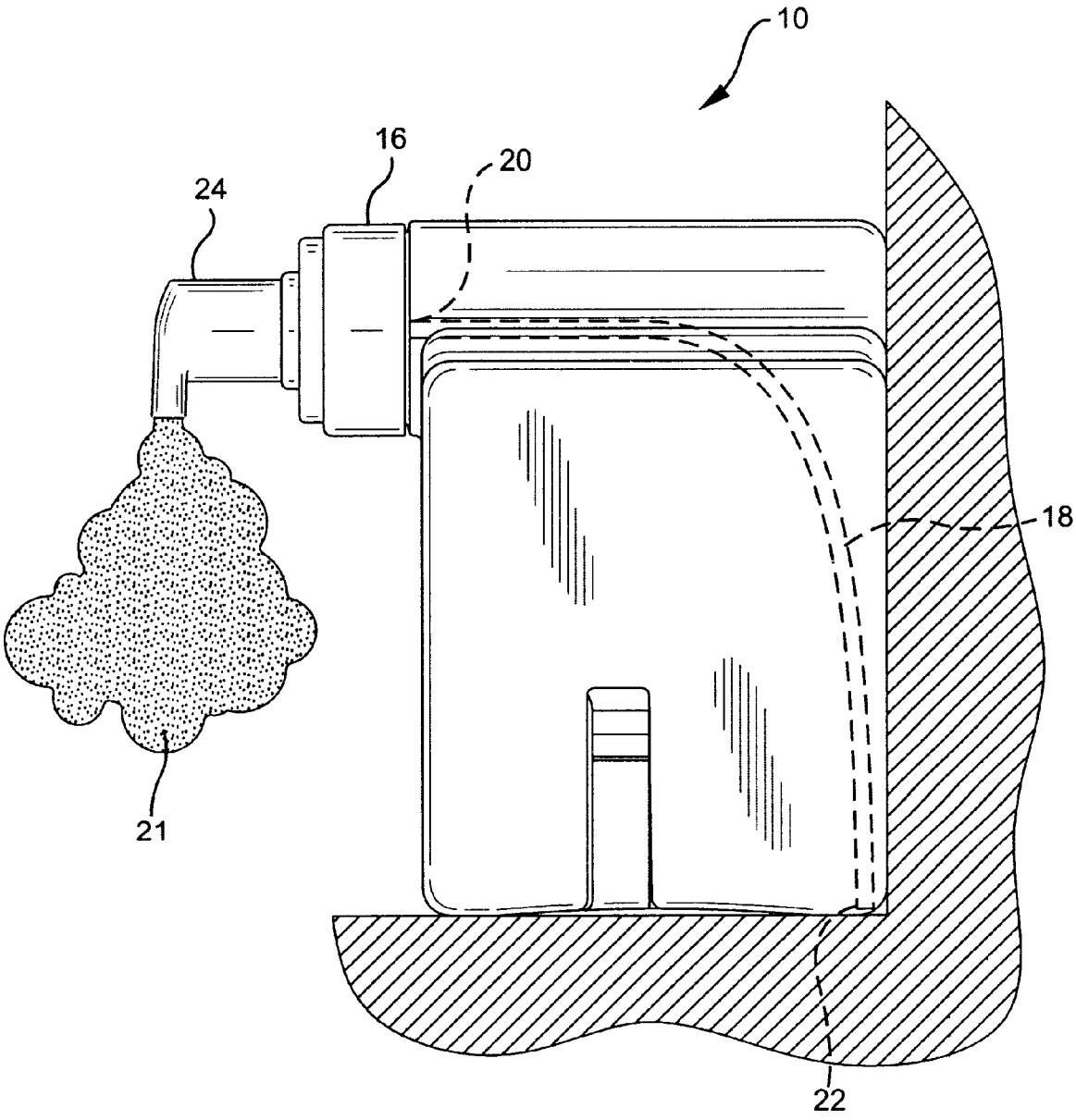

The foam dispensing device 10, further includes a dip tube 18 having a first end 20 connected to the piston pump 16 for supplying liquid to the piston pump to generate foam 21 when the piston pump is depressed. The dip tube 18 also has a second end 22 positioned adjacent the planar surface 14 so that the foam dispensing device can dispense foam when substantially the entire quantity of the foamable liquid has been dispensed from the container. The second end 22 of the dip tube 18 is positioned in a manner that allows the dispensing device to dispense foam when the foamable liquid has been substantially depleted from the container, when the container is positioned in a first, generally horizontal position, and in a second, generally vertical position. FIG. 1 shows the dispensing device in a horizontal position, such as on a table top. FIGS. 2*a* and 2*b* show the foam dispensing device in an a substantially vertical position. Because the connection between the piston pump 16 and the container 12 is fluid tight, fluid does not leak from the container when the container is in a substantially vertical position as shown in FIGS. 2*a* and 2*b*.

Preferably, wherein the piston pump includes a nozzle 24 capable of being rotated independently of the threaded connection to provide for the directional adjustment of the nozzle. When the dispensing device 10 is moved from the generally horizontal position as shown in FIG. 1 to the generally vertical position shown in FIGS. 2*a* and 2*b*, the nozzle 24 is rotated 180 degrees so that the nozzle is pointed in a downward position to dispense the foam 21.

Figure 3:
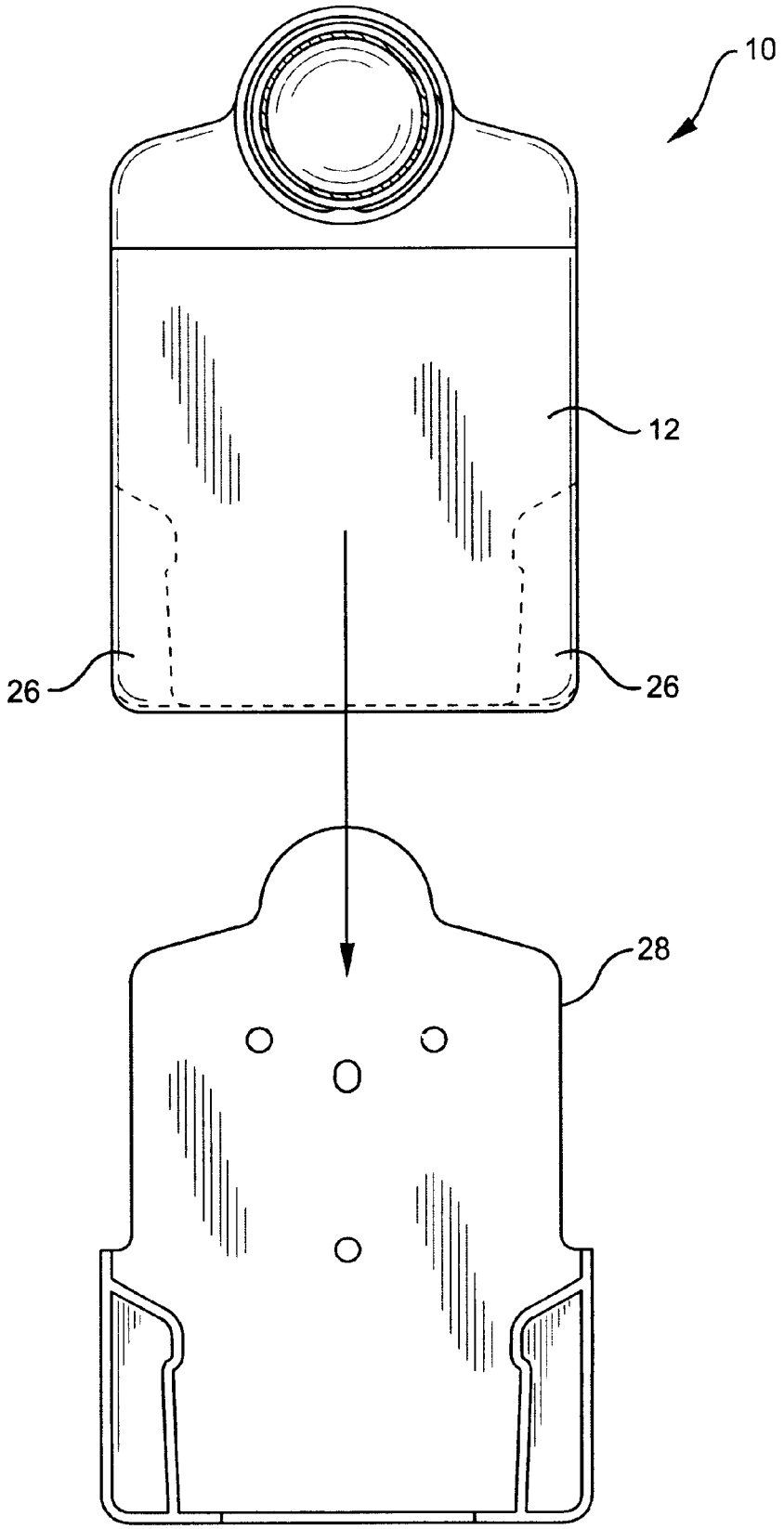
FIG. 3 shows a foam dispensing container and a mounting bracket.

Referring to FIG. 3, preferably, the foam dispensing device 10 further includes means for removably mounting the container to a generally vertical surface. The container 12 may include indentations 26 that cooperate with a mounting bracket 28 that can be mounted to a wall or another generally vertical surface. Of course, a variety of other means could be used to mount the container 12 to a generally vertical surface. For example, the container 12 could include hooks molded into the surface of the container (not shown), mounting protrusions that cooperate with a mounting bracket, or an adhesive for affixing the dispensing device to a generally vertical surface.

The present invention provides a self-contained or "stand alone" foam dispenser than can be utilized in multiple areas throughout the hospital setting. These areas include areas where the permanent mounting of a hand pump containing wall bracket is impractical or undesirable. However, in areas where a permanently mounted bracket is desirable, the foam dispenser of the present invention is capable of being mounted to a vertical surface with a much smaller and more convenient bracket than conventional systems.

The foam dispenser of the present invention greatly reduces the chance for cross contamination when compared with prior art bulk dispensing devices. This is due to the fact that in the self-contained foam dispenser, the entire foam generating device, pump, and all other components in contact with the air or solution, are disposed of after each bottle of solution is used. For conventional hand pump dispensers, the air delivery source contained in the wall mounted bracket, including the piston, housing, check valve, and the like are used over years, and they may become contaminated. This can result in the delivery of contaminated air into the solution-containing bottle resulting in much increase risk of cross contamination throughout the healthcare setting.

The current invention described herein has the versatility to be used in a generally, vertical upright position in a bracket or by laying on a flat surface in any desired location. This allows for an expanded range of product use to any place such a foam dispenser is desirable or needed without the need for any installation of a hand pump containing, wall mounted bracket. Another key feature to this type of dispenser is the very controlled delivery of foamed solution per pump. This allows for cost containment through a controlled delivery dose of foamed solution. Waste is reduced, as the user receives a controlled, predictable amount of solution each pump.

The foam dispensing device can be used with antimicrobial solutions, for example, solutions containing iodine, chlorhexidine gluconate, parachlorometa-xylenol, triclosan, hexachlorophene and alcohol. Other solutions may be developed for use with this dispenser to promote hand washing practices in alternate sites such as the home healthcare and food handler markets. An advantage of the invention is that foamed solution can be dispensed and collected with one hand. The currently available hand pump foam dispensers used in the healthcare industry require two hands to dispense and collect the solution required to perform a hand wash.

The foam dispensing device of the present invention provides a closed system in that it can be inverted without spilling or losing any solution. The foam dispenser described in this invention disclosure is capable of pumping and foaming higher viscosity solutions, those having a range of 0–200 centipoise. This self-contained foam dispenser gives the user the efficacy of sound antimicrobial solutions with the convenience and appeal of a foamed solution. Additionally, this device can be used to meet the hand washing needs in the established areas, such as in the hospital setting, and in the home healthcare setting.

It will be apparent to those skilled in the art that various modifications and variations can be made in the device of the present invention without departing from the spirit or scope of the invention. Thus, it is intended that the present invention cover the modifications and variations of this invention provided they come within the scope of the appended claims and their equivalents.

What is claimed is:

1. A foam dispensing device comprising:

a container for holding a foamable liquid and defining a top surface, a bottom surface, a front surface and a rear surface;

a foam generating piston pump attached to the container adjacent to the top surface and having a nozzle adjacent to an intersection between the front surface and the top surface to prevent liquid leaking from the container;

a one piece dip tube that acts as a passageway to allow liquid to flow therethrough having a first end connected to the piston pump for supplying liquid to the piston pump to generate foam, the dip tube having a second end positioned adjacent an intersection between the bottom surface and the rear surface so that the foam dispensing device can dispense foam when substantially the entire quantity of the liquid has been dispensed from the container when the container is positioned in a first, generally horizontal position, or a second, generally vertical position;

wherein the first end of the dip tube is positioned proximate to the intersection between the front surface and the top surface; and wherein the dip tube is formed of a material that does not deform substantially under the force of gravity when the dip tube is positioned in the container.

2. The foam dispensing device of claim 1, wherein the piston pump is attached to the container by a threaded connection.

3. The foam dispensing device of claim 2, wherein the nozzle is capable of being rotated independently of the threaded connection to provide for directional adjustment of the nozzle.

4. The foam dispensing device of claim 3, further comprising means for removably mounting the container to a generally vertical surface.

5. The foam dispensing device of claim 1 further comprising means for maintaining the second end of the dip tube in position during operation of the foam dispensing device.

6. The foam dispensing device of claim 5 wherein the maintaining means comprises indentations formed in the container.

7. The foam dispensing device of claim 6 wherein the indentations extend, at least in part, parallel to the rear surface of the container.

* * * * *